United States Patent [19]

Hansen

[11] Patent Number: 4,582,016

[45] Date of Patent: Apr. 15, 1986

[54] COLLAPSIBLE FRAME STRUCTURE FOR BOAT ROOF

[76] Inventor: Gerold B. Hansen, 1200 River Rd., Marysville, Mich. 48040

[21] Appl. No.: 624,474

[22] Filed: Jun. 25, 1984

[51] Int. Cl.[4] ..... B63B 17/02

[52] U.S. Cl. ..... 114/361; 114/71; 135/88; 135/107

[58] Field of Search ..... 114/71, 361; 296/108, 296/109, 114, 121, 122; 403/102, 101, 92, 91, 113, 117; 135/107, 88, 102, 103, 109

[56] References Cited

U.S. PATENT DOCUMENTS

| | | | |
|---|---|---|---|
| 336,467 | 2/1886 | Bex et al. | 296/108 |
| 349,079 | 9/1886 | Bex et al. | 296/108 |
| 596,490 | 1/1898 | Edwards | 403/353 |
| 1,448,646 | 3/1923 | Ward | 285/283 |
| 1,535,009 | 4/1925 | Zanetti | 296/108 |
| 2,011,723 | 8/1935 | Miller | 296/108 |
| 2,098,423 | 11/1937 | Kennedy | 285/110 |
| 2,162,347 | 6/1939 | Haberstump | 296/121 |
| 2,823,684 | 2/1958 | Sartori | 135/109 |
| 3,097,883 | 7/1963 | Gilson et al. | 296/137 |
| 3,298,733 | 1/1967 | Kerby et al. | 296/108 |
| 3,680,448 | 8/1972 | Ballingall | 403/113 |
| 3,698,409 | 10/1972 | Koontz | 114/361 |
| 3,896,832 | 7/1975 | Montoya | 114/361 |
| 3,923,047 | 12/1975 | Chant | 403/102 |
| 4,075,723 | 2/1978 | Bareis | 114/361 |
| 4,091,484 | 5/1978 | Means | 114/361 |

*Primary Examiner*—Trygve M. Blix
*Assistant Examiner*—C. T. Bartz
*Attorney, Agent, or Firm*—Harness, Dickey & Pierce

[57] ABSTRACT

A segmented frame structure for a convertible boat top including first and second segmented frame members, with the second frame member being pivotally connected to the first so that the second member can be pivoted into a closed position adjacent to the first frame member. Each of the frame members includes a plurality of frame segments which are pivotally connected by hinge structures that provide for stability and integrity of the segmented structure in an operative condition, but which allow the segments of each frame member to be folded transversely upon themselves to yield a configuration of substantially reduced size to facilitate storage and shipment. The principles of the invention are applicable to multi-frame top structures for yielding further reductions in storage and shipping volumes.

29 Claims, 10 Drawing Figures

FIG. 1.
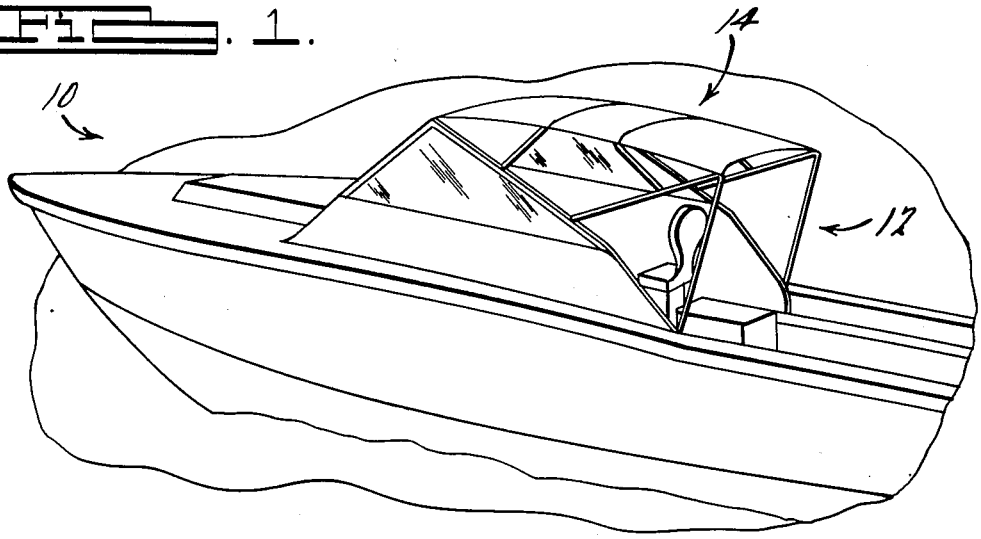
FIG. 3.
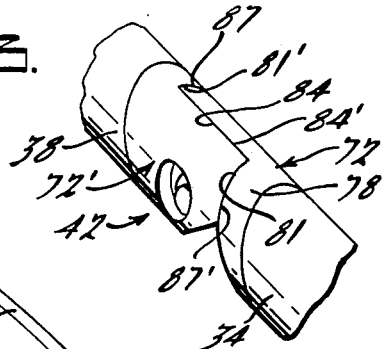
FIG. 2.
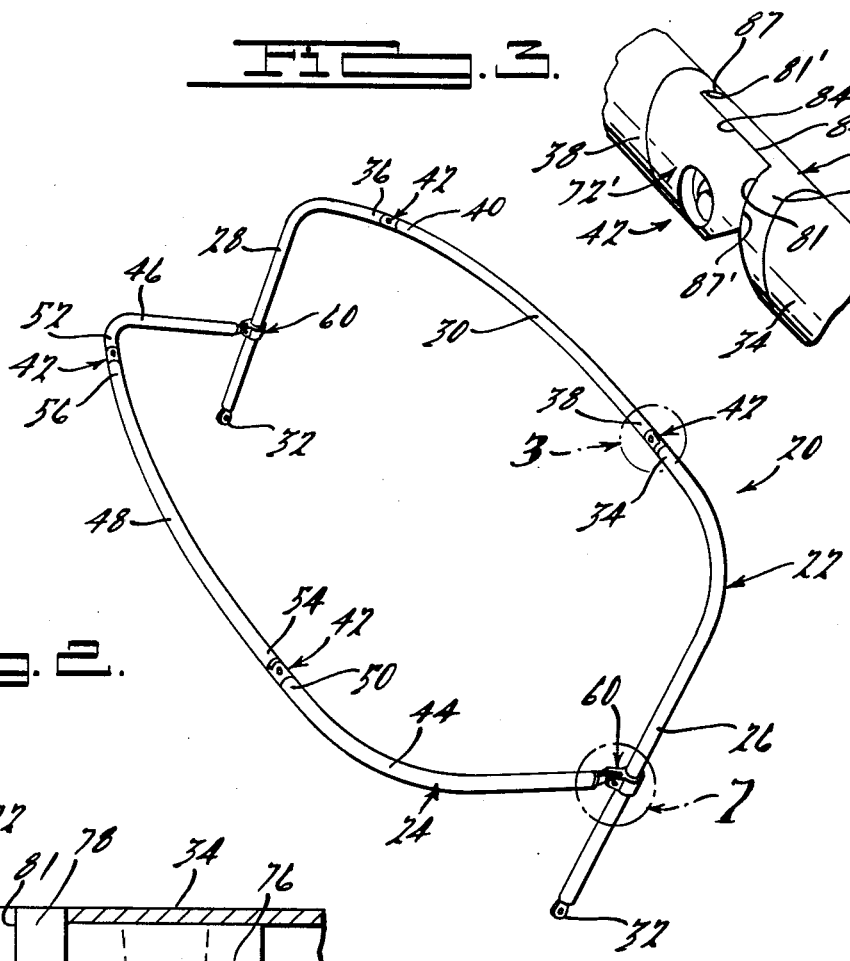
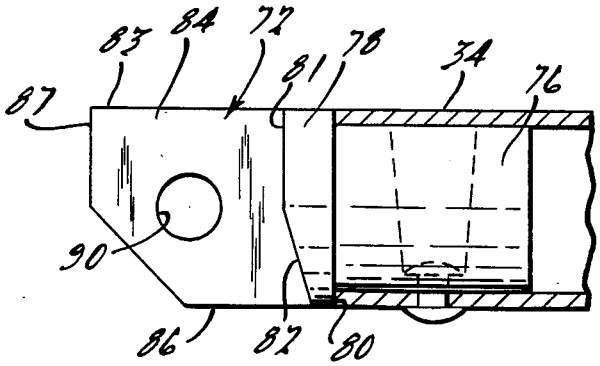
FIG. 4.

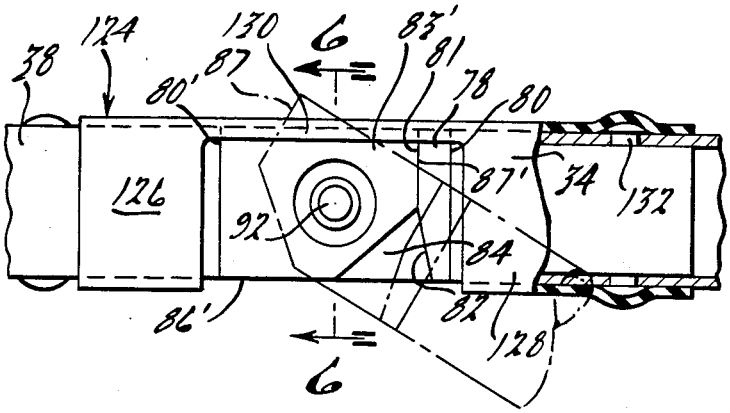
FIG. 5.
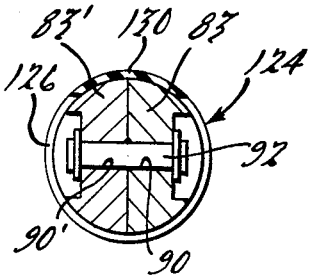
FIG. 6.
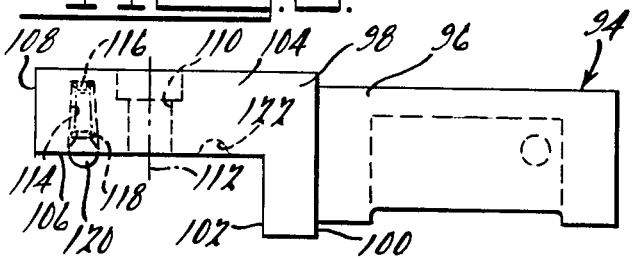
FIG. 10.
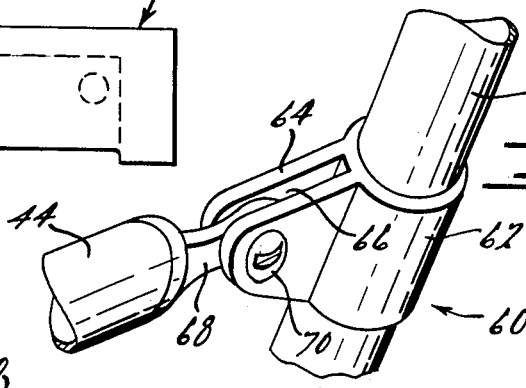
FIG. 7.
FIG. 8.
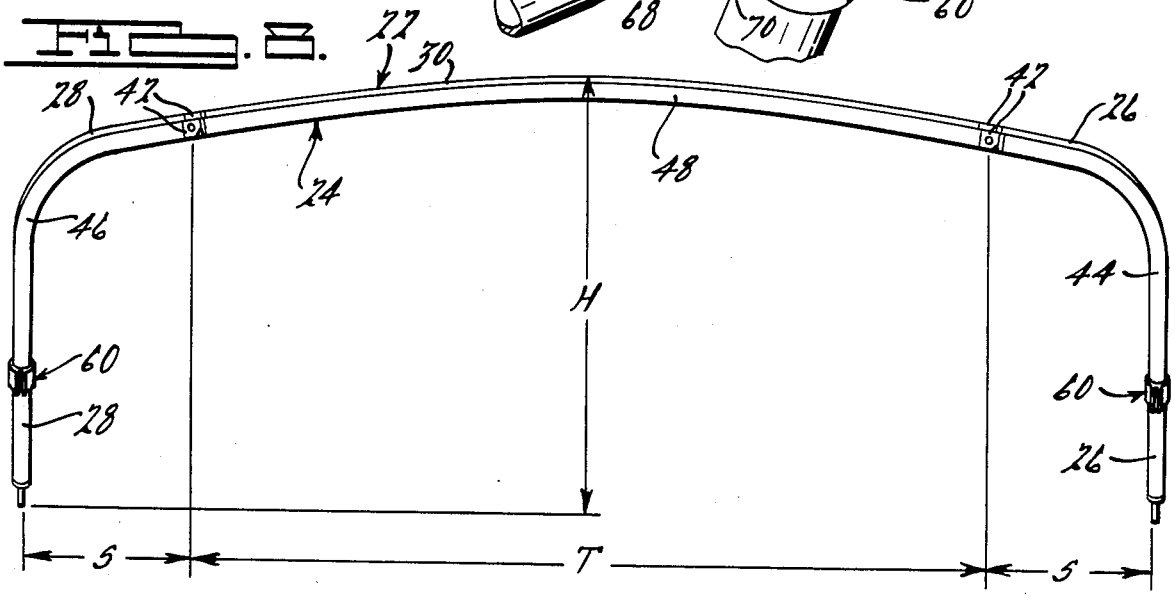
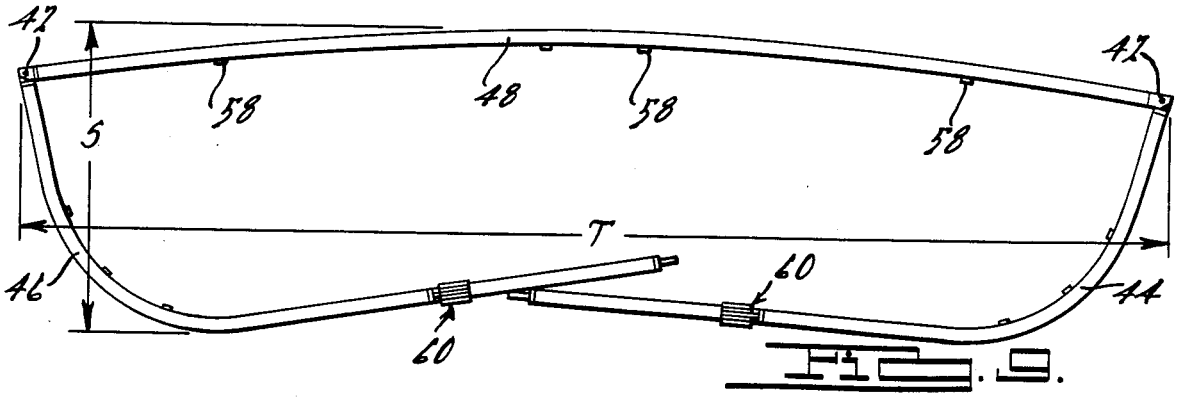
FIG. 9.

COLLAPSIBLE FRAME STRUCTURE FOR BOAT ROOF

BACKGROUND AND SUMMARY OF THE INVENTION

The present invention relates to frame structures adapted for carrying and supporting flexible or convertible type tops utilized in marine transportation vehicles such as recreational boats and the like, and more particularly to an improved collapsible frame structure for such use which facilitates shipping and storage of same.

As is well known, many inboard and outboard recreational boats have cockpit and/or seating areas equipped with convertible type top or roof structures. Such convertible top structure typically comprise a flexible roofing material which is carried on a supporting frame structure that can be expanded from a closed position into an operative position to protect the operator and/or occupants from the elements, such as sun and water, during boat operation. Many such frame structures are designed to be stored adjacent the windshield area of the boat, and/or can be detached and removed therefrom for storage in the boat or in another area when not in use. In other applications, the frame structures have been supported for movement in tracks located on the top rails or gunnels on opposite sides of the boat which permit the frame structure to be moved forwardly for storage, or rearwardly to accommodate storage at the stern such as adjacent the transom of the boat.

The overall geometry of such prior frame structures create disadvantages when such structures are not in use. In particular, due to the fact that they are often designed to extend across the width of the cockpit or seating area of a boat, prior known convertible top frame structures define substantial cross-sectional areas even in a closed or storage condition. Thus, unless steps are taken to disassemble such prior frame structures, they require a large amount of storage area when not in use, or shipping volume when being shipped. Since storage areas are usually at a premium on board a boat, the problem of storing these prior frame structures is particularly acute if storage is desired on the boat itself. Moreover, shipping requirements have often necessitated shipment of such structures in a disassembled condition due to their inherent geometry.

It is, therefore, desirable to provide a convertible boat top frame structure which yields a less bulky and more convenient configuration for storage either on or off of a boat when not in use. It is moreover desirable to provide such a structure which can be easily and readily placed in a storage or shipping condition without the need for disassembly or its components.

The present invention is intended to satisfy the above desirable features and objectives through the provision of new and improved convertible boat top frame structure. More particularly, the frame structure includes first and second generally U-shaped segmented frame members, with the second frame member being pivotally connected to the first so that the second member can be pivoted into a closed position adjacent to the first frame member. Each of the frame members is defined by a plurality of frame segments which are connected through novel hinge structures that provide for stability and integrity of the segmented structure in an operative condition, but which allow the segments of each frame member to be folded transversely upon themselves to yield a configuration of substantially reduced size to facilitate storage and shipment of the structure without the need for disassembly.

The above and other features of the invention will become apparent from a reading of the detailed description of the preferred embodiment, which makes reference to the following set of drawings.

BRIEF DESCRIPTION OF THE DRAWINGS

FIG. 1 is a partial perspective view of a recreational boat illustrating a convertible top structure operative to provide protection for the occupants of a boat;

FIG. 2 is a perspective view of the convertible top frame structure of the present invention;

FIG. 3 is a partial perspective view taken generally in the direction of Line 3 of FIG. 2;

FIG. 4 is an elevational view of one embodiment of a portion of the hinge structure of the invention;

FIG. 5 is an elevational view, partially in section and partially in phantom, of the hinge structure of the invention;

FIG. 6 is a sectional view taken in the direction of Line 6—6 of FIG. 5;

FIG. 7 is a partial perspective view taken generally in the direction of Line 7 of FIG. 2;

FIG. 8 is an elevational view illustrating the frame structure of the invention in a partially collapsed condition;

FIG. 9 is an elevational view showing the frame structure of the invention in a fully collapsed condition; and FIG. 10 is an elevational view of an alternate embodiment of a portion of the hinge structure of the invention.

DETAILED DESCRIPTION OF THE PREFERRED EMBODIMENT

Referring now more specifically to the drawings, a recreational boat 10 is shown in FIG. 1 having a typical cockpit area 12. In order to provide protection from the elements such as sun and water, the cockpit area 12 is provided with a convertible top such as shown at 14. The structure illustrated in FIG. 1 is intended to be representative of convertible boat tops generally, and is thus illustrative only of the general operative environment of the present invention.

A convertible boat top frame structure in accordance with the present invention is shown generally in FIG. 2 at 20. The frame structure 20 includes a segmented generally U-shaped primary frame member 22, and a similarly shaped segmented secondary frame member 24 which is pivotally attached to the primary frame member 22 as described more fully hereinafter. The segmented primary frame member 22 is comprised of hollow aluminum tubing formed to define two L-shaped leg portions 26 and 28, and an arcuate central spanning member 30. The leg portions 26 and 28 are provided at their exposed ends with connectors 32 operative to allow the entire frame structure 20 to be removably mounted and/or located on a boat in the cockpit or other occupant area where the frame structure 20 is to be utilized. The connectors 32 also enable the structure 20 to be supported for movement in tracks located along the gunnels of particular boats to facilitate forward and rearward movement of the structure 20 as desired. The opposite ends 34 and 36 of leg portions 26 and 28, respectively, are disposed adjacent ends 38 and 40 of the central spanning member 30 and are pivotally connected therewith by way of hinges 42. The segmented secondary frame member 24 is similarly comprised of hollow tubing formed to define two L-shaped leg portions 44 and 46, and an arcuate central spanning member 48. The inner ends 50 and 52 of the leg portions 44 and 46, respectively, are pivotally connected to the spanning member 48 at opposite ends 54 and 56 thereof by way of hinges 42 identical to those utilized in the primary frame member 22. As shown in FIG. 9, one or both of the frame members 22 and 24 can be provided with snap-type fasteners 58 adapted to receive complimentary fasteners disposed upon a flexible material to secure the flexible material to the structure 20 in a manner well-known in the art to yield a convertible top structure. Such flexible material may be of coated or uncoated fabric, as well as perforated fabric or screen-like materials.

As shown in FIGS. 2 and 7, secondary frame member 24 is attached to primary frame member 22 by way of pivotal connections 60. Each of the connections 60 comprises a collar portion 62 which can be fastened or press fitted onto leg portions 26 and 28 of the primary frame member 22. A bifurcated tongue 64 extends from each of the collar portions 62 to define an elongated receiving slot 66 for receiving a male eyelet member 68 secured to the exposed ends of each of the leg portions 44 and 46 of the secondary frame member 24. Each of the eyelets 68 is pivotally secured within its respective receiving slot 66 by way of a pivot pin such as shown at 70 in FIG. 7. The pivotal connections 60 are situated longitudinally along leg portions 26 and 28 of primary frame member 22 to allow the secondary frame member 24 to be pivoted between open and closed positions such as shown in FIGS. 2 and 8.

The hinges 42 effecting the pivotal connections between the leg portions and the spanning members of the segmented primary and secondary frame members 22 and 24 are identical in configuration, so that the following description is applicable equally to each. The hinge 42 effecting the pivotal connection between leg portion 26 and central spanning member 30 of the primary frame member 22 is illustrated in FIGS. 3 through 6. The hinge 42 is defined by a pair of opposed hinge portions 72 and 72' secured to end 34 of leg portion 26 and end 38 of central spanning member 30, respectively. These hinge portions 72 and 72' are mirror images of each other, and thus in the following description, it is understood that hinge portion 72' includes elements which are functionally identical mirror images of the described elements of hinge portion 72, so that the description herein of hinge portion 72 is equally applicable to hinge portion 72'. The mirror elements of hinge portion 72' specifically illustrated in the drawings and/or described herein which correspond with elements of hinge portion 72 are identified with a "prime number" designation.

Hinge portion 72 includes a cylindrical shank 76 having an outer diameter that allows it to be received within end 34 of hollow leg portion 26 and secured therein by means of either a press fit or a fastener. A generally cylindrical collar portion 78 having an outer diameter equal to that of leg portion 26 is disposed axially adjacent shank 76 to define an annular load bearing shoulder 80 which abuts the end 34 of leg portion 26 as shown in FIG. 4. The opposite side of collar 78 is formed to define transversely extending first and second locating faces 81 and 82, respectively, which are operative to define the limits of possible angular movement of hinge 42 as described more fully below. Extending normally of locating face 81 is an elongated tongue portion 83 which defines an axially extending mating surface 84, an outer cylindrical engagement surface 86, and which terminates in an end face 87. The tongue portion 83 is also formed with a transversely extending aperture 90 which is operative to be aligned with a similar transversely extending aperture 90' formed within tongue portion 83' of opposed hinge portion 72' for receiving a pivot pin 92 to pivotally connect the hinge portions 72 and 72' to form the hinge 42.

The assembled hinge 42 which operatively connects leg portion 26 and spanning member 30 is shown in FIGS. 2, 3, 5 and 6. Upon such assembly, the mating surfaces 84 and 84' of hinge portions 72 and 72' are situated in an opposed abutting relationship as shown in FIG. 3. FIG. 5 illustrates the pivoting capability of the assembly, with leg portion 26 shown in phantom in a non-operative position. When leg portion 26 and spanning member 30 are pivoted into an operative position, as shown in FIGS. 2, 3 and 5, end face 87 of hinge portion 72 is adapted to abuttingly engage first locating face 81' of hinge portion 72', while end face 87' of hinge portion 72' is adapted to abuttingly engage locating face 81 of hinge portion 72. Moreover, when the frame structure 20 is placed under longitudinal and transverse loads as it carries and supports a flexible screen or roof material, the opposed surfaces 84 and 84', 87 and 81', and 87' and 81 cooperate to yield an overall interference engagement between hinge portions 72 and 72'. The hinge 42 thus provides an operative load bearing connection between the adjacent frame segments 26 and 30 which contributes to the structural integrity of the frame structure 20 under both longitudinal and transverse loads placed upon the frame members 22 and 24 during use of the frame structure 20. This feature is also present in each of the pivotal connections between the other frame segments of members 22 and 24 since each of the hinges 42 utilized in the structure 20 is of identical design and assembled configuration.

On the other hand, the provision of segmented frame members 22 and 24 having the above-described hinges 42 pivotably connecting adjacent frame segments gives the frame structure 20 clearly advantageous characteristics that enable the segmented structure 20 to be easily and readily placed in a shipping or storage condition without the necessity of disassembling the structure 20. In this regard, if a user desires to remove the frame structure 20 from a boat for storage or shipping, the proportions of the spanning members and leg portions of frame members 22 and 24 enable the structure 20 to be collapsed initially in a first direction by pivoting the secondary frame member 24 from the operative position shown in FIG. 2 to a position adjacent primary frame member 22 as shown in FIG. 8. In this latter position, the spanning members 30 and 48 are in an aligned abutting relationship, and the hinges 42 disposed at either end of the spanning members 30 and 48 are positioned with their pivot axes located in a substantially parallel if not coaxial relationship. In this configuration, the proportions of the spanning members and leg portions of the frame members 22 and 24 enable the leg portions 26, 28, 44 and 46 to be folded simultaneously toward each other and toward the central spanning members 30 and 48 to yield a fully collapsed configuration such as shown in FIG. 9.

The limit of pivotal movement of the leg portions 26, 28, 44 and 46 relative to the spanning members 30 and 48 is determined by the interaction of engagement surfaces 84 and 86′ with second locating faces 82 and 82′ of each of the hinges 42. In the preferred embodiment of the invention, the second locating faces 82 and 82′ are oriented to allow for greater than 90° pivotal movement of the leg portions 26, 28, 44 and 46 relative to the spanning members 30 and 48 to maximize the reduction of the frame structure 20 from its operative size to its collapsed configuration. This feature enables the frame structure 20 to be collapsed from an operative configuration having a cross-sectional area shown in FIG. 8 of approximately [H×(S+T+S)] square inches to a configuration having a cross-sectional area of approximately [S×T] square inches as shown in FIG. 9. It has been found that when the frame structure 20 is placed in the fully collapsed condition such as shown in FIG. 9, the cross-sectional area of [S×T] is roughly one-fifth of that defined by the frame structure 20 when in an open condition such as shown in FIG. 8. This reduction in cross-sectional area is achieved simply through the above-described folding operation without disassembling any of the frame components. As is readily apparent, this feature of the frame structure 20 is particularly advantageous for storing and/or shipping the frame structure 20, and thus yields a frame structure believed to be a marked improvement over prior known boat convertible top frame structures, and the invention enables shipment by UPS as opposed to by conventional motor freight carriers. On the other hand, if desired, the invention also enables the segmented frame structure 20 to be disassembled into its segmented components to yield an even greater reduction in required shipping or storage volume over prior boat top frame structures having non-segmented frame members.

An alternate embodiment of a hinge portion in accordance with the teachings of the invention is shown in FIG. 10 at 94. As with the previously described embodiment, hinge portion 94 is designed to be assembled with a mirror image hinge portion to effect a load bearing hinge structure operatively connecting adjacent frame elements of the frame structure 20. Since hinge portion 94 and its mirror image counterpart are identical in design, only hinge portion 94 will be described hereinafter. Hinge portion 94 includes a cylindrical shank 96 having an outer diameter that allows it to be received within the end of one of the previously described hollow segmented frame elements and secured therein by means of either a press fit or a fastener. A generally cylindrical collar portion 98 having an outer diameter equal to that of its associated frame segment is disposed axially adjacent shank 96 to define an annular load bearing shoulder 100 which abuts the end of the associated frame segment to which it is assembled for transmission of loads therebetween. The side of collar portion 98 opposite shoulder 100 is formed to define a transversely extending locating face 102, as well as a second locating face (not shown), each of which effectively operate as do locating faces 81 and 82 of the previously described embodiment to define the limits of possible angular movement of the hinge during operation. Extending normally of locating face 102 is an elongated tongue portion 104 which defines an axially extending mating surface 106, and which terminates in an end face 108. The tongue portion 104 is also formed with a transversely extending aperture 110 which is operative to be aligned with a similar transversely extending aperture formed in the mirror image of hinge portion 94 for receiving a pivot pin to pivotally connect the hinge portions for pivotal movement about a pivot axis 112.

The hinge portion 94 is also formed with a transversely extending tapered bore 114 which communicates from mating surface 106 into the interior of tongue portion 104. Formed at the interior base of bore 114 is a cylindrical locating seat 116 which serves to locate a coil spring 118, which in turn seats a ball 120 and biases same against the mirror image surface of mating surface 106 when hinge portion 94 and its mirror image counterpart are assembled together. The radial distance of ball 120 from pivot axis 112 is such that each mating surface 106 remains in engagement with the ball 120 of the opposed hinge portion to locate and retain the opposed ball 120 in its associated bore 114 during pivotal movement of the hinge portions 94. On the other hand, the mating surface 106, as well as its mirror image counterpart, is further formed with a hemispherical depression or detent 122 which is operative to receive the exposed portion of the spring biased ball 120 when the hinge portions 94 are pivoted about axis 112 into a load bearing configuration. The bores 114, balls 120 and detents 122 thus effectively operate to lock the hinge portions 94 into their load bearing configuration to retain the hinge structure and associated frame segments in an operative position and inhibit movement therefrom. However, the spring force placed upon each ball 120 by its associated spring 118 may be overcome by placing a sufficient moment upon the hinge structure to disengage balls 120 from detents 122 to enable the user to fold adjacent frame segments into their respective storage positions.

In addition to the above, each of the previously described embodiments of the invention may be outfitted with flexible protective collars of the type shown in FIG. 5 at 124 at each of the hinge locations of the frame structure 20. Each collar 124 is formed from an elastomeric material to define spaced hollow cylindrical sleeve portions 126 and 128 which are operative to be fitted over the ends of adjacent frame members such as 34 and 38. Each collar 124 also defines an integral elongated arcuate bridge portion 130 which communicates between sleeve portions 126 and 128 and which is operative to cover a portion of the hinge structure pivotally connecting the adjacent frame segments. The overall longitudinal length of collar 124 is such as to enable it to be fitted over one of the fastener connections such as shown at 132 to effect a frictional retention of the collar 124 at the hinge location. As so retained, the collar 124 is free to move and flex during pivotal movement of adjacent frame segments. However, the bridge portion 130 at all times defines a protective barrier between the hinge portions and the flexible roof material with which the frame structure 20 is utilized. The collar 124 is thus operative to prevent the hinge portions from engaging and snagging the flexible roof material when the frame structure 20 is moved between its operative and storage positions.

It should be noted that certain boat top applications require not only two, but three, four and even five U-shaped members which cooperatively define a frame structure for supporting the boat top. While the embodiment of the invention shown in the drawings comprises a pair of generally U-shaped frame members, the novel hinge and segmented frame component features of the invention can be applied in such more complex boat top applications, so that each frame member can be collapsed from an operative condition to a storage or shipping condition in the manner described hereinabove. As is readily apparent, the advantages of the invention will yield even further shipping or storage space savings in such multi-frame applications.

It is understood that the foregoing description is that of the preferred embodiment of the invention and that various changes and modifications may be made thereto without departing from the spirit and scope of the invention as defined in the appended claims.

What is claimed is:

1. A frame structure for supporting a flexible material for a marine vehicle convertible roof operative to provide protection for a vehicle occupant area having a predetermined length, said frame structure comprising a plurality of frame segments operatively connected in series relationship to define a segmented frame member having a spanning dimension equal to said predetermined length, and a load bearing hinge structure having a pivot axis and which operatively connects the opposed ends of two adjacent frame segments and allows one of said adjacent segments to be rotated about said pivot axis toward the other of said adjacent segments to collapse said segmented frame member to a dimension which is less than said spanning dimension, said hinge structure including a first hinge portion attached to one of said opposed ends and a second hinge portion attached to the other of said opposed ends, said first and second hinge portions defining opposed engagement surfaces which are adapted to effect a positive engagement to prevent pivotal movement of said adjacent frame segments when said frame structure is placed under load.

2. A frame structure as set forth in claim 1 further comprising a protective collar extending between said opposed ends of said two adjacent frame segments and which covers a portion of said hinge structure to prevent said hinge structure from engaging said flexible material of said roof during movement of said segmented frame member into and out of said spanning dimension.

3. A frame structure as set forth in claim 2 wherein said protective collar comprises a flexible elastomeric material.

4. A frame structure as set forth in claim 1 wherein said second hinge portion cooperates with said first hinge portion to define a load bearing configuration which transmits loads between said opposed ends when said segmented frame member defines said spanning dimension, and said hinge structure further includes retaining means which generates a force for inhibiting relative movement between said first and second hinge portions when they are moved into said load bearing configuration.

5. A frame structure as set forth in claim 1 wherein said engagement surfaces include at least two engagement surfaces extending transversely of the longitudinal axes of said adjacent frame segments and which positively engage each other when said frame structure is placed under load.

6. A frame structure as set forth in claim 1 wherein said engagement surfaces include first and second pairs of engagement surfaces extending transversely of the longitudinal axes of said adjacent frame segments, one surface of each pair being adapted to positively engage the second surface of that pair when said frame structure is placed under load.

7. A frame structure as set forth in claim 6 wherein said first and second pairs of engagement surfaces are disposed in a substantially parallel relationship when said frame structure is placed under load.

8. A frame structure as set forth in claim 1 wherein said engagement surfaces are disposed in planes parallel to and spaced from said pivot axis and can be rotated about said pivot axis into positive engagement with one another.

9. A frame structure as set forth in claim 1 wherein said engagement surfaces include a first surface on said first hinge portion extending substantially parallel to said pivot axis, and a second surface on said second hinge portion extending substantially parallel to said pivot axis, said second surface being engageable with said first surface when said hinge structure is loaded in a direction extending transversely of said pivot axis to prevent said pivotal movement.

10. A frame structure as set forth in claim 1 wherein said hinge structure further includes means for limiting the extent of rotation of said one adjacent segment about said pivot axis towards said other adjacent segment.

11. A frame structure as set forth in claim 10 wherein said limiting means comprises a first limit surface on said first hinge portion which engages a second limit surface on said second hinge portion when said one adjacent segment is rotated through a predetermined amount of angular displacement about said pivot axis toward said other adjacent segment to prevent further rotation of said one adjacent segment beyond said predetermined amount.

12. A frame structure as set forth in claim 4 wherein said retaining means comprises a ball member partially received within a bore in said first hinge portion, and a detent formed in an exterior surface of said second hinge portion, with said ball member being biased against said exterior surface by a spring disposed within said bore and being partially receivable within said detent when said first and second hinge portions are moved into said load bearing configuration to inhibit relative movement between said first and second hinge portions.

13. A frame structure for supporting a flexible screen material for a recreational boat convertible roof, said frame structure comprising a segmented primary frame member formed by an elongated primary spanning member and first and second generally L-shaped end portions pivotally connected to opposite ends of said primary spanning member by first and second hinge structures, said end portions being pivotable between respective operative positions adjacent the ends of said primary spanning member to cooperatively define with said primary spanning member a rigid generally U-shaped load bearing configuration encompassing a primary spanning area and respective collapsed positions to define a collapsed configuration encompassing an area which is less than said primary spanning area, a segmented secondary frame member formed by an elongated secondary spanning member and first and second generally L-shaped leg portions pivotally connected to opposite ends of said secondary spanning member by third and fourth hinge structures, said leg portions being pivotable between respective operative positions adjacent the ends of said secondary spanning member to cooperatively define with said secondary spanning member a rigid generally U-shaped load bearing configuration encompassing a secondary spanning area and respective collapsed positions to define a collapsed configuration encompassing an area which is less than said secondary spanning area, said secondary frame member being movable relative to said primary frame member between an operative position in which said secondary spanning area is spaced from said primary spanning area and a position adjacent said primary frame member, said first leg portion of said secondary frame member being pivotally connected to said first end portion of said primary frame member, said second leg portion of said secondary frame member being pivotally connected to said second end portion of said primary frame member, with said first end portion and said first leg portion being simultaneously pivotable into their respective collapsed positions and said second end portion and said second leg portion being simultaneously pivotable into their respective collapsed positions when said secondary frame member is positioned adjacent said primary frame member.

14. A frame structure as set forth in claim 13 wherein each of said hinge structures includes first and second hinge portions pivotally connected to each other and defining opposed engagement surfaces which are adapted to effect a positive engagement to prevent pivotal movement of their associated frame segments when said frame structure is placed under load.

15. A frame structure as set forth in claim 14 wherein each said hinge structure includes retaining means between its first and second hinge portions which automatically generates a force for inhibiting relative movement between said first and second hinge portions when said primary frame member and said secondary frame member are moved into their respective load bearing configurations.

16. A segmented frame structure for supporting a flexible material for a marine vehicle convertible roof operative to protect an occupant area of the vehicle, said structure comprising an elongated spanning member, a first end portion pivotally connected by a first hinge structure to one end of said spanning member, a second end portion pivotally connected by a second hinge structure to the other end of said spanning member, said first and second end portions being pivotable between respective operative positions adjacent the ends of said spanning member to yield a rigid load bearing configuration defining a spanning area and respective collapsed positions to define a collapsed configuration encompassing a collapsed area which is less than said spanning area, with each of said first and second hinge structures including a first hinge portion attached to said spanning member and a second hinge portion attached to an associated end portion, with said first and second hinge portions of each said hinge structure defining opposed engagement surfaces which are adapted to effect a positive engagement to prevent pivotal movement of said first and second end portions relative to said spanning member when said frame structure defines said spanning area.

17. A frame structure as set forth in claim 16 wherein said structure further comprises a segmented secondary frame member formed by a plurality of frame segments pivotally connected to each other in a series relationship and moveable between respective operative positions to yield a second rigid load bearing configuration encompassing a secondary spanning area and respective collapsed positions to define a collapsed configuration encompassing an area which is less than said secondary spanning area.

18. A frame structure as set forth in claim 16 wherein each of said end portions are of a generally L-shaped configuration and cooperate with said spanning member to define a generally U-shaped rigid structure when pivoted into said load bearing configuration.

19. A frame structure as set forth in claim 18 wherein said structure further comprises a segmented secondary frame member formed by a plurality of frame segments operatively connected in a series relationship, with the opposite ends of said secondary frame member being pivotally attached to said first anad second end portions.

20. A frame structure as set forth in claim 19 wherein the opposed ends of each adjacent frame segment of said secondary frame member are pivotally connected with each other.

21. A frame structure as set forth in claim 18 wherein said structure further comprises a segmented generally U-shaped secondary frame member defining first and second leg portions which are pivotally connected with said first and second end portions and an elongated secondary spanning member extending between said first and second leg portions, with one end of said secondary spanning member pivotally connected to said first leg portion and the opposite end of said secondary spanning member pivotally connected to said second leg portion.

22. A frame structure as set forth in claim 21 wherein said secondary frame member is pivotable about an axis extending through said first and second end portions.

23. A frame structure as set forth in claim 21 wherein said first and second leg portions are pivotable between respective operative positions adjacent the ends of said secondary spanning member to yield a rigid load bearing configuration encompassing a secondary spanning area and respective collapsed positions to define a collapsed configuration encompassing an area which is less than said secondary spanning area.

24. A frame structure as set forth in claim 13 wherein said first hinge structure defines a first pivot axis about which said first end portion is pivotable, and said second hinge structure defines a second pivot axis extending substantially parallel to said first pivot axis and about which said second end portion is pivotable.

25. A frame structure as set forth in claim 13 wherein said secondary frame member is pivotable about an axis extending through said first and second end portions of said primary frame member.

26. A frame structure as set forth in claim 24 wherein said third hinge structure defines a third pivot axis about which said first leg portion is pivotable, and said fourth hinge structure defines a fourth pivot axis extending substantially parallel to said third pivot axis and about which said second leg portion is pivotable.

27. A frame structure as set forth in claim 26 wherein said first and second pivot axes are disposed in the same first plane, and said third and fourth pivot axes are disposed in the same second plane.

28. A frame structure as set forth in claim 26 wherein said first and third pivot axes are disposed in a substantially parallel relationship and said second and fourth pivot axes are disposed in a substantially parallel relationship when said secondary frame member is positioned adjacent said primary frame member.

29. A frame structure as set forth in claim 26 wherein said first and third pivot axes are disposed in substantially coaxial alignment and said second and fourth pivot axes are disposed in substantially coaxial alignment when said secondary frame member is positioned adjacent said primary frame member.

* * * * *